United States Patent [19]

Kennedy

[11] Patent Number: 4,632,255

[45] Date of Patent: Dec. 30, 1986

[54] FOLDABLE CLOTHES HANGER

[76] Inventor: William D. Kennedy, 2201 Westbury Ct., SW., Decatur, Ala. 35603

[21] Appl. No.: 724,415

[22] Filed: Apr. 18, 1985

[51] Int. Cl.[4] ..... A47F 5/08

[52] U.S. Cl. ..... 211/1.3; 211/100; 211/104; 211/105.3

[58] Field of Search ..... 211/99, 100, 1.3, 104, 211/105.3; 248/205.5, 206.3, 206.4

[56] References Cited

U.S. PATENT DOCUMENTS

| | | | |
|---|---|---|---|
| 1,696,483 | 12/1928 | Hiering | 248/206.4 X |
| 1,739,801 | 12/1929 | Pitts | 248/206.3 X |
| 2,587,111 | 2/1952 | Cashen | 211/1.3 |
| 2,647,643 | 8/1953 | Cruikshank | 211/100 |
| 2,778,705 | 1/1957 | Barker | 211/1.3 X |
| 3,032,273 | 5/1962 | Spielman | 211/105.3 X |
| 3,249,233 | 5/1966 | Marcus et al. | 211/105.3 |
| 3,941,250 | 3/1976 | Ott | 211/100 X |
| 4,171,748 | 10/1979 | Fabian | 211/1.3 |

*Primary Examiner*—Robert W. Gibson, Jr.

*Attorney, Agent, or Firm*—George J. Porter

[57] ABSTRACT

A foldable clothes hanger assembly comprising an elongated telescopic arm assembly (9) and a channel shaped receptacle (12) open on one side for receiving the telescopic arm assembly (9). The telescopic arm assembly (9) is pivotally connected at a first end within the lower end of the channel shaped receptacle (12) in a manner to allow the telescopic arm assembly (9) to be pivotable into and out of the open side of the channel shaped receptacle (12). A support element (18) is mounted at one of its ends to the second end of the telescopic arm assembly (9) and at its other end is mounted within the channel shaped receptacle (12) in a manner to enable the telescopic arm assembly (9) to be selectively pivoted into the channel shaped receptacle (12) or to be pivoted out of the channel shaped receptacle (12) to a horizontal position and upon which clothes or conventional clothes hangers can be hung. The receptacle (12) can be mounted vertically upon a closet wall, for example, or over a bathtub for hanging wet clothes to dry out.

5 Claims, 4 Drawing Figures

FOLDABLE CLOTHES HANGER

TECHNICAL FIELD

This invention relates generally to foldable clothes hangers and more particularly to an improved foldable clothes hanger whose length can be increased as desired.

BACKGROUND OF THE INVENTION

There are several prior art clothes hangers of the type comprising a fixed length elongated arm or rod which is foldable into or out of a receiving receptacle hung on a wall and which can be extended horizontally from the receptacle outwardly so that clothes can be hung thereon, either directly or by means of conventional clothes hangers. More specifically, an elongated channel shaped receptacle is usually secured to a wall within a closet or bathroom, for example, and within which the foldable arm is suitably hinged at one end so that when not in use the arm can be folded up and back into an open side of the channel shaped receptacle. Appropriate supporting means is usually secured at one of its ends within the channel shaped receptacle and, at its other end to the foldable arm. The supporting means can be hinged near its center or made slidable within the channel shaped receptacle and, when fully extended, functions to support the foldable arm in its horizontal position for use as a clothes hanger.

Some examples of the prior art are given below. U.S. Pat. No. 3,941,250 to OTT shows a foldable support which is foldable within an elongated vertical housing, vertical mountable on a suitable wall. The foldable support can be selectively pivoted between a raised position within the vertical housing or a horizontal position extending outwardly from the vertically mounted housing. U.S. Pat. No. 4,171,748 to FABIAN shows a foldable hanger assembly for mounting on a wall. The assembly includes an elongated housing to which is pivotally connected a hanger arm that is storable within the housing when not in use. The hanger arm can be lowered to a horizontal position for supporting clothes hangers and the like. A support is hingedly secured at one end to the hanger arm and at the opposite end is slidably engaged with the housing at a point intermediate the length of the housing.

U.S. Pat. No. 1,582,762 to KLOCK shows a foldable clothes hanger which comprises a supporting channel for mounting vertically on a wall. A retaining strip is secured within the supporting channel with a clearance between the sides and back of the retaining strip and the side walls and back wall of the supporting channel. A foldable arm is pivotally secured at one end to a U-shaped element which fits behind the retaining strip so as to be slidable up and down thereon. A supporting arm extends from the top of the channel to a point near the center of the foldable arm to permit the foldable arm to be moved to a horizontal position and supported in such horizontal position by said supporting arm and a stop element located within the channel which limits the upward motion of the U-shaped element. To fold the foldable arm into the supporting channel the U-shaped element is slid downwardly and the foldable arm moves in an arcuate path upwardly and into the channel with the hinged supporting arm also moving in an arcuate path back into the channel. U.S. Pat. No. 2,484,535 to STADER shows a clothes hanger which can also be used as a door knocker. An arm is pivotally connected at one end to a lower end of a channel shaped element which is secured vertically on an appropriate vertical surface such as a door or a closet wall. When not in use the arm can be folded upwardly into the channel shaped element for storage.

A principal disadvantage of the prior art structures is the fixed length of the foldable arm. Such fixed length not only limits the depth of space in which the device is to be used but necessarily results in the channel shaped element being at least as long as the foldable arm.

It is an object of the present invention to provide a foldable clothes hanger whose useful length is variable.

Another object of the invention is to provide a more compact foldable arm clothes hanger than heretofore known.

A third object of the invention is to provide a foldable clothes hanger having a compact, channel shaped receptacle for receiving and storing a foldable telescopic arm assembly whose length can be varied in any desired amount from a minimum length approximating the length of the channel shaped receptacle to more than double such minimum length.

SUMMARY OF THE INVENTION

In accordance with a preferred form of the invention there is provided a channel shaped receptacle which has a backwall element, two sidewall elements extending perpendicularly from the parallel edges of the back element, and which can be closed at both ends with end closing elements which are secured to the ends of the backwall element and the two sidewall elements. The front sidewall of the channel shaped receptacle opposite the backwall element can be a hinged cover which can be opened to allow use of the foldable multi-element arm assembly and closed after the receptacle receives and stores the multi-element telescopic arm assembly which is pivoted at a first end thereof between the opposite sidewall elements of the channel shaped receptacle in a manner such that the telescopic arm assembly can be pivoted or folded out to a horizontal position so as to be in a position to hold clothes or clothes hangers. A supporting arm which can be hinged near its center has one end pivotally secured to a point near the midpoint of the channel shaped receptacle and its other end pivotally secured to the second end of the outside arm element of the multi-element telescopic arm assembly. In its horizontal, folded out position one or more of the remaining arm elements of the multi-element telescopic arm assembly can be extended to a desired length to accomodate a greater number of clothes or clothese hangers.

DETAILED DESCRIPTION OF THE INVENTION

Figure 1:
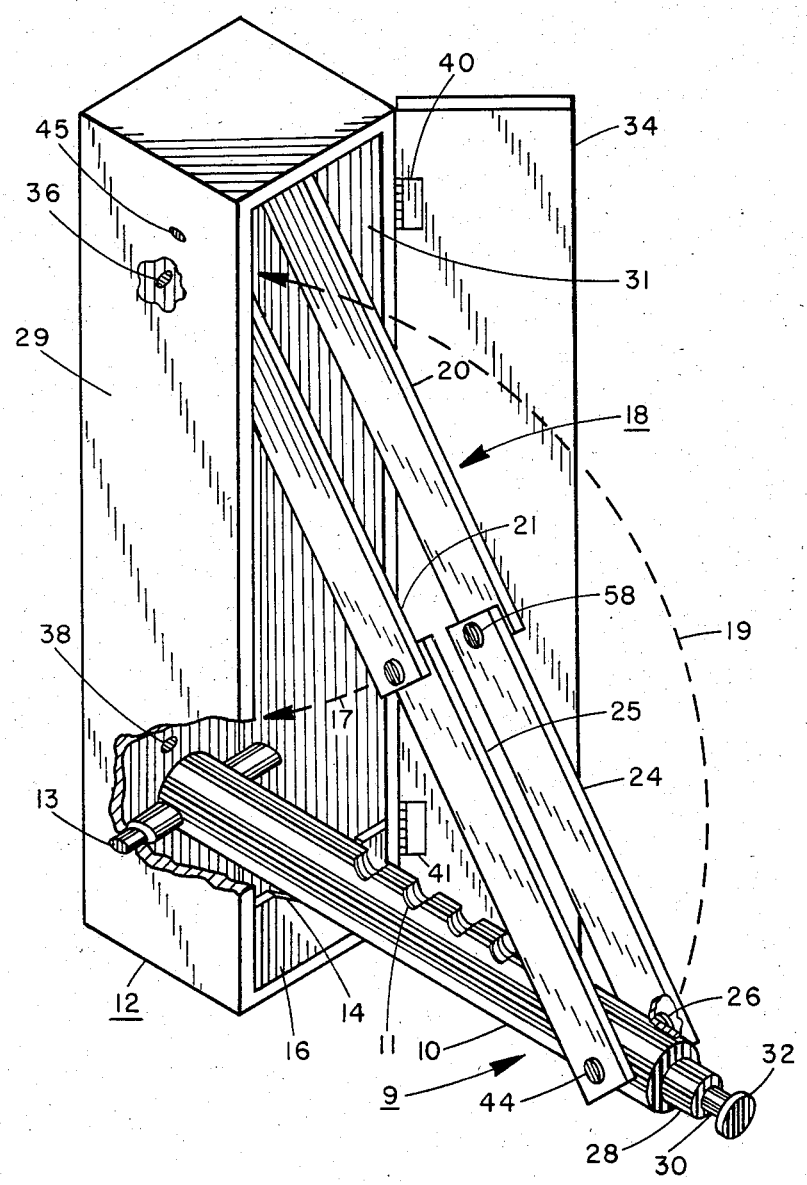
FIG. 1 is a perspective view of the invention in unfolded position with the invention partially cut away to show details of construction.

Referring now to FIG. 1 a multi-element telescopic arm assembly (or arm assembly) 9 is comprised of two or more telescopic arm elements (or arm elements) including a main outside tubular shaped arm element 10, and second and third arm elements 28 and 30, all of which can be formed with grooves, such as grooves 11, along the top surface thereof to receive conventional clothes hangers or the like. The telescopic arm assembly 9 is pivotal on a pin 13 into and out of an elongated rectangularly shaped receptacle 12 which can be mounted vertically on a wall by means of screws inserted through holes 36 and 38 of backwall 33 of receptacle 12. The pin 13 extends through holes formed in the opposite side walls 29 and 31 of receptacle 12 and also through holes formed in the two first ends of the two upper flat elements 21 and 20 of supporting arm or bracket 18. As discussed briefly above the arm assembly is telescopic in design and includes a second arm element 28 which telescopes inside the main arm element 10 and a third arm element 30 which telescopes into arm element 28. The button shaped element 32 at the end of arm element 30 prevents third arm element 30 from being inserted too far into arm element 28 and provides a means for extending the arm elements 30 and 28 out of the main arm element 10 in a conventional telescopic manner.

The foldable telescopic arm assembly 9 rests in the arcuate section 14 of the partial front wall 16 of the receptacle 12 when the telescopic arm assembly 9 is pivoted downwardly to be in its horizontal position and is further supported by the supporting arm 18.

Figure 2:
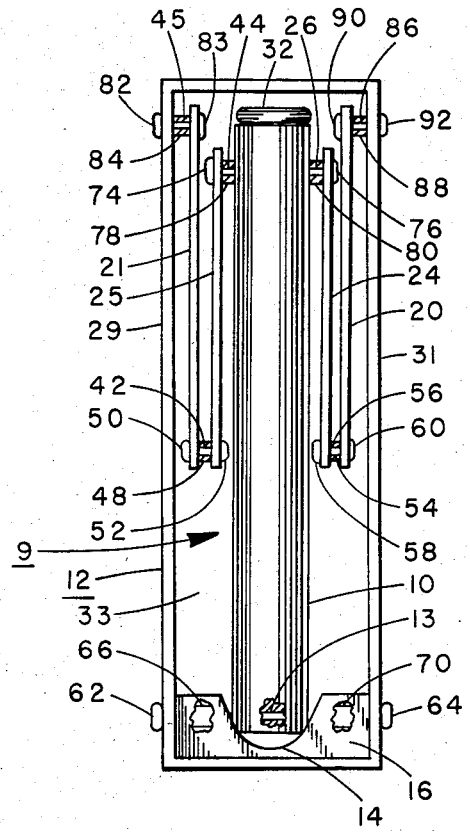
FIG. 2 is a front elevational view of the invention with the invention in folded position in its receptacle.

Supporting arm 18, in one form, can be formed of two sections secured together in a hinged manner by a pair of pins 42 and 54 (see FIG. 2). Each of the sections of the supporting arm 18 is formed of two parallel elements. More specifically, the upper portion of the supporting arm 18 consists of two flat elongated elements 20 and 21, each of which is supported in a spaced-apart manner from the inner walls of receptacle 12 by means of pins and spacers which are more clearly shown in FIG. 2. More specifically element 21 is supported to side wall 29 of receptacle 12 by a pin 45 which extends through a hole 45 formed in the side wall 29 of receptacle 12 and element 21 and spaced from the receptacle sidewall 29 by spacer 84. In a similar manner pin 86 and spacer 88 are employed to secure the flat element 20 a predetermined distance from receptacle side wall 31.

The bottom portion of the supporting arm 18 shown in FIG. 1 consists of two flat elements 24 and 25 which, as mentioned above, are secured to the two elements 20 and 21 forming the top portion of the supporting arm by pins 42 and 54 (see FIG. 2) at one end and to the second end of the main telescopic arm element 10 by pins 44 and 26 which are secured as by welding to the outside surface of the main telescopic arm element 10. The pins 44 and 26 cannot extend through the main telescopic arm element 10 since they would then necessarily have to pass through the telescopic arm elements 28 and 30 and prevent their being withdrawn from the main arm element 10.

Appropriate spacers 78 and 80, shown in FIG. 2, but not in FIG. 1, are employed to space the flat elements 25 and 24, respectively, a desired distance from the perimeter of the main arm element 10.

To close the telescopic assembly 9 into the receiving receptacle 12 the supporting arm 18 will pivot inwardly towards the receptacle 12 in the direction of arrow 17 and finally rest fully within receptacle 12 while the end of the telescopic arm assembly 9 will move in an arcuate path shown by arrow 19 into the upper portion of receptacle 12.

A front wall element 34 can be connected by hinges 40 and 41 to sidewall element 31 of receptacle 12 and functions to completely enclose the support arm 18 and the telescopic arm assembly 9 within the receptacle 12 when they are both folded into receptacle 12.

Referring now more specifically to FIG. 2 the entire assembly is shown in a closed position with the supporting arm 18 and the telescopic arm assembly 9 both folded entirely within the receiving receptacle 12.

Figure 3:
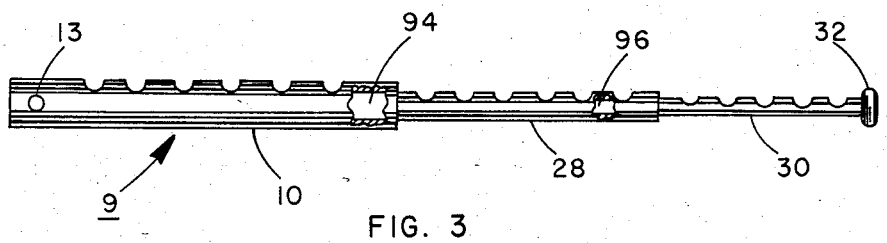
FIG. 3 is a side view of the multi-element telescopic arm assembly shown fully extended.

It should be noted that elements of FIG. 2 and also those of FIG. 3 which correspond to elements of FIG. 1 are identified by the same reference characters.

In addition to the elements shown in FIG. 1 there is also shown in detail in FIG. 2 the spacers mentioned briefly in connection with the description in FIG. 1. More specifically, the spacers 84 and 88, which fit around pins 45 and 86, function to space the support arm elements 21 and 20, respectively, a predetermined distance from the side walls 29 and 31 of receptacle 12. The spacers 78 and 80, which fit around pins 44 and 26, function to space the support arms 25 and 24, respectively, a specified distance from the main telescopic arm element 10, and the spacers 48 and 56 which fit around pins 42 and 54, respectively, function to space the support arm elements 25 and 21 a specified distance apart and also the support arms 20 and 24 a specified distance apart.

Although not shown in FIG. 1 each of the pins 45, 86, 44, 26, 42, and 54 have heads at either end thereof such as heads 82, 83, 90, 92, 74, 76, 50, 52, 58, and 60, which hold the pins 45, 86, 44, 26, 42, and 54 in their proper positions so that they won't slip laterally.

In a similar manner spacers 66 and 70 fit around the pin 13 and space the telescopic arm assembly 9 equal distances from the two side walls 29 and 31 of the receptacle 12. The heads 62 and 64 of pin 13 hold pin 13 in its proper position in the assembly. It should be noted that the heads referred to herein as heads of the pins can actually be the ends of rivets or other suitable means for holding the pins in their proper positions.

Referring now to FIG. 3 there is shown a side view of the telescopic arm assembly 9 with the telescopic arm elements 28 and 30 telescoped out from each other and from the main telescopic arm element 10. It can be seen from FIG. 3 that the arm element 28 fits inside a cylindrical opening 94 within arm element 10 and that arm element 30 fits within the cylindrical opening 96 in arm element 28.

Figure 4:
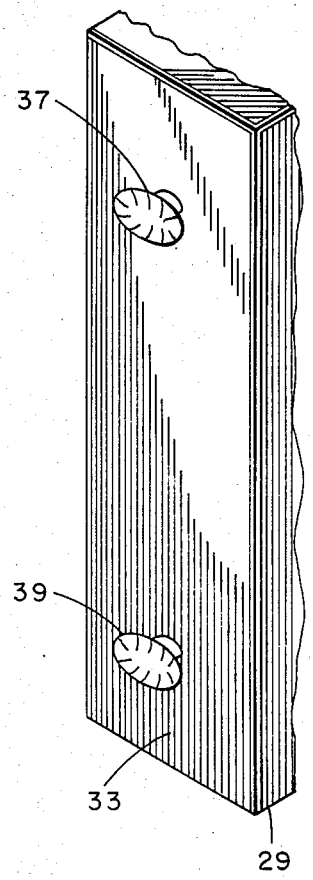
FIG. 4 is a perspective view of the back wall of the receptacle with suction cups secured thereto.

If desired, suction cups 37 and 39 can be secured to the external surface of the back wall 33 of the receptacle 12, as shown in FIG. 4, to enable the securing of receptacle 12 to a tile wall, for example, over a bath tub to permit the hanging of wet clothing on the telescopic arm assembly 9 to permit drip drying of the clothing.

It is to be noted that various other designs apparent to those of ordinary skill in the art can be employed in the invention without departing from the spirit or scope thereof. For example, the pins 45 and 86 can be combined into a single long pin which extends across the top of the button or cap 32 when the telescopic arm assembly 9 is in a closed position. Such an arrangement would necessitate a slight increase in the length of the receptacle 12 as represented in FIG. 2.

I claim:

1. A foldable clothes hanger comprising:

a recantagular receptacle having an upper and a lower end, parallel long sides, parallel short sides connected to said long sides, a back portion connected to each of said sides, said back portion having mounting holes in the upper and lower ends thereof, an open side opposite said back portion, a partial front wall attached to the lower open side of said receptacle, and a door pivotally connected to one of said long sides so as to selectively open and close said open side;

a cylindrical arm having an inner end and an outer end, said arm being pivotally attached at its inner end to the lower end of said receptacle so as to be rotatable into and out of the open side of said receptacle, and being supported by said partial front wall while in its outward position;

a pair of hinged support elements each pivotally attached at one end to opposite sides of the outer end of said cylindrical arm and pivotally attached at opposite ends to the inside of said parallel long sides adjacent the upper end of said receptacle whereby said support elements may be folded along with said arm completely within said receptacle and closed therein by said door.

2. A foldable clothes hanger as set forth in claim 1 wherein the portion of said partial front wall which supports the cylindrical arm is arcuate for snug fitting engagement with said arm so as to prevent lateral movement of said arm.

3. A foldable clothes hanger as set forth in claim 2 wherein said cylindrical arm includes elements therein adapted to telescope outwardly therefrom.

4. A foldable clothes hanger as set forth in claim 3 in which the said cylindrical arm and its telescoping elements have serrated or notched top surfaces to receive and hold the hooked top portions of conventional clothes hangers.

5. A foldable clothes hanger as set forth in claim 4 which further comprises suction cups secured to the mounting holes of the back wall of said receptacle for attaching the receptacle to a smooth surface.

* * * * *